US009207586B2

(12) United States Patent
Rokugawa

(10) Patent No.: US 9,207,586 B2
(45) Date of Patent: Dec. 8, 2015

(54) IMAGE FORMING DEVICE

(71) Applicant: Oki Data Corporation, Tokyo (JP)

(72) Inventor: Hiroshi Rokugawa, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/335,480

(22) Filed: Jul. 18, 2014

(65) Prior Publication Data

US 2015/0023678 A1 Jan. 22, 2015

(30) Foreign Application Priority Data

Jul. 19, 2013 (JP) ..... 2013-150624

(51) Int. Cl.
*G03G 15/16* (2006.01)
*G03G 15/01* (2006.01)

(52) U.S. Cl.
CPC ..... *G03G 15/1675* (2013.01); *G03G 15/1605* (2013.01); *G03G 15/0131* (2013.01); *G03G 2215/0119* (2013.01); *G03G 2215/0177* (2013.01)

(58) Field of Classification Search
CPC ..... G03G 15/16
USPC ..... 399/66
See application file for complete search history.

(56) References Cited

U.S. PATENT DOCUMENTS

| | | | | | |
|---|---|---|---|---|---|
| 5,697,015 | A * | 12/1997 | Ream et al. | 399/66 |
| 5,857,135 | A * | 1/1999 | Hayashida et al. | 399/296 |
| 7,308,214 | B2 * | 12/2007 | Hattori et al. | 399/55 |
| 8,050,582 | B2 * | 11/2011 | Aiba | 399/66 |
| 8,428,493 | B2 * | 4/2013 | Mase | 399/167 |
| 8,712,267 | B2 * | 4/2014 | Sugimoto et al. | 399/66 |
| 2006/0024074 | A1 * | 2/2006 | Maeda et al. | 399/44 |
| 2011/0255885 | A1 * | 10/2011 | Yugeta et al. | 399/27 |
| 2013/0064559 | A1 * | 3/2013 | Nakamura et al. | 399/44 |
| 2013/0136468 | A1 * | 5/2013 | Shimizu et al. | 399/44 |
| 2013/0177329 | A1 * | 7/2013 | Tanaka et al. | 399/66 |
| 2014/0376937 | A1 * | 12/2014 | Watanabe | 399/66 |
| 2015/0023678 | A1 * | 1/2015 | Rokugawa | 399/66 |

FOREIGN PATENT DOCUMENTS

| | | | | |
|---|---|---|---|---|
| JP | 2011-039378 | * | 2/2011 | G03G 15/16 |
| JP | 2011-039378 | A | 2/2011 | |

* cited by examiner

*Primary Examiner* — Clayton E Laballe
*Assistant Examiner* — Kevin Butler
(74) *Attorney, Agent, or Firm* — Rabin & Berdo, P.C.

(57) ABSTRACT

An image forming device has multiple image forming units that form developing agent images, an intermediate transfer member to which developing agent images are transferred from selected image forming units, and a transfer member for transferring the developing agent images from the intermediate transfer member to a recording medium, using a voltage supplied from a voltage supply unit. The voltage supply unit varies the voltage supplied to the transfer member, either before or after or both before and after the developing agent images are transferred from the intermediate transfer member to the recording medium, according to the number of selected image forming units or their disposition.

21 Claims, 9 Drawing Sheets

IMAGE FORMING DEVICE

BACKGROUND OF THE INVENTION

1. Field of the Invention

This invention relates to an image forming device.

2. Description of the Related Art

Color image forming devices such as color electrophotographic printers have a plurality of image forming units aligned in sequence, each image forming unit including a photosensitive drum, a charging means, an exposure means, and a developing means using a developing agent such as toner. In many tandem color image forming devices, such as the one described by Shiobara in Japanese Patent Application Publication No. 2011-039378, toner images are first transferred sequentially from each image forming unit onto an intermediate transfer belt to create a color image. The color image is then transferred from the intermediate transfer belt to a recording medium in a single secondary transfer process. The color image is permanently fixed to the recording medium by a fuser and the printing operation is completed.

SUMMARY OF THE INVENTION

The toner in the image forming units is electrically charged to a certain level. If some of the toner particles are inadequately charged, or charged with reverse to the normal polarity, a problem referred to as fogging occurs, in which excess toner adheres to the photosensitive drum outside the intended image forming region. If many of the toner particles are charged with reverse polarity, the fogging problem worsens and toner adhering outside the image forming region may be transferred from the photosensitive drum via the intermediate transfer belt to the secondary transfer roller. Toner that has been transferred onto the transfer roller then adheres to the reverse side of the recording medium in the next printing operation, lowering the quality of the printed output. Compared with black, yellow, magenta, and cyan toner, the white toner used in printing on transparent media, for example, tends to have a higher proportion of reversely charged toner particles, and therefore has a particular tendency to cause problems by soiling the reverse side of recording media.

An object of the present invention is to avert reduced printing quality due to soiling of the reverse side of recording media.

The invention provides a novel image forming device having a plurality of image forming units for forming developing agent images, an intermediate transfer member to which developing agent images are transferred from selected ones of the image forming units, a transfer member for transferring the developing agent images from the intermediate transfer member to a recording medium to form an image on the recording medium, and a voltage supply unit for supplying a voltage to the transfer member. The voltage supply unit varies the voltage supplied to the transfer member, either before or after the developing agent images are transferred from the intermediate transfer member to the recording medium or both before and after the developing agent images are transferred from the intermediate transfer member to the recording medium, responsive to the number or disposition of the selected image forming units.

One aspect of the invention can avoid reduced printing quality due to soiling of the reverse side of recording media.

DETAILED DESCRIPTION OF THE INVENTION

Figure 1:
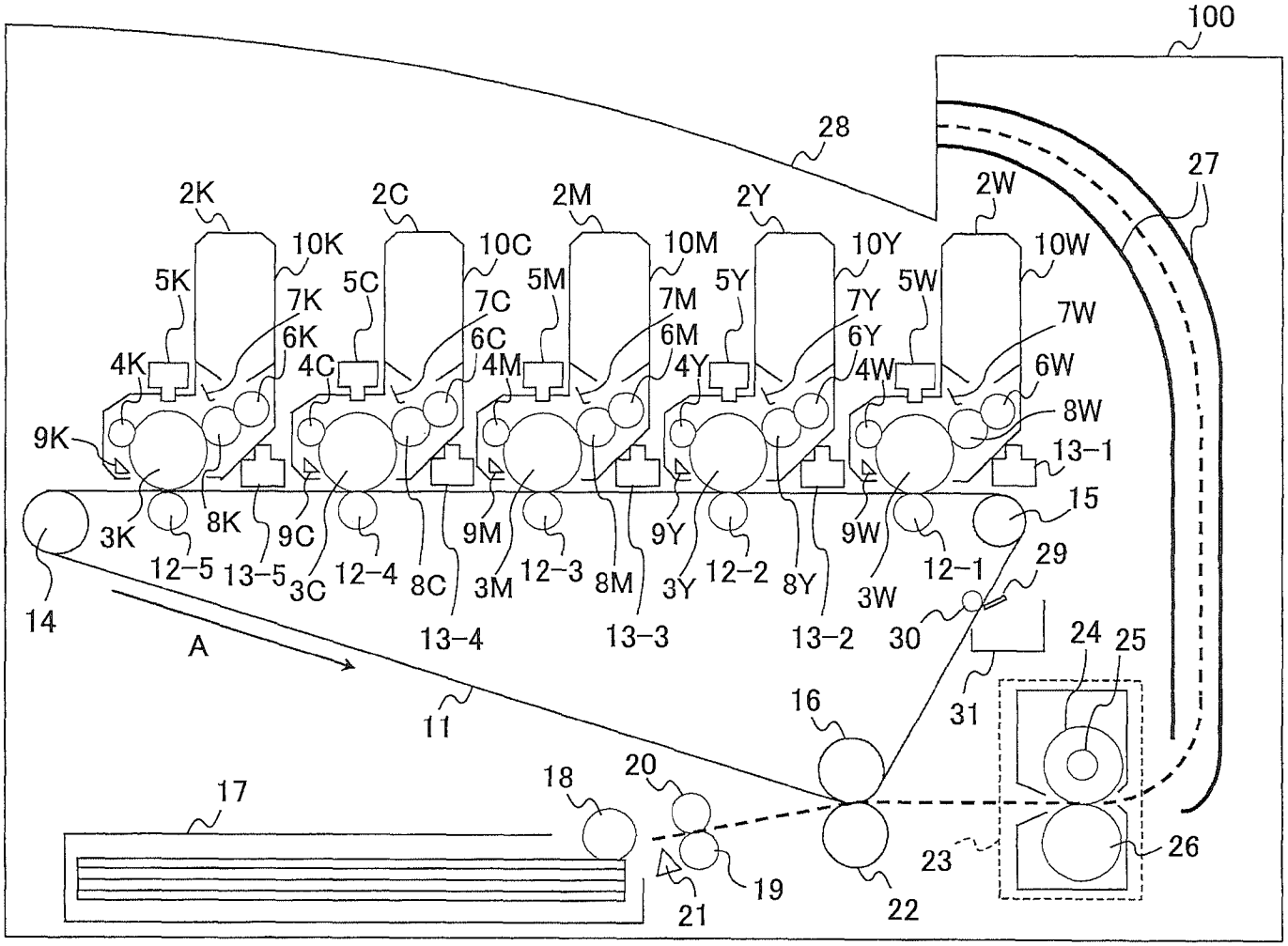
FIG. 1 is a schematic sectional view of the overall structure of a printer in a first embodiment.

Embodiments of the invention will now be described with reference to the attached drawings, in which like elements are indicated by like reference characters.

First Embodiment

Referring to the cross sectional view in FIG. 1, the image forming device in the first embodiment is a printer 100 having five independent image forming units 2W, 2Y, 2M, 2C, 2K that form images in the respective colors white (W), yellow (Y), magenta (M), cyan (C), and black (K). The printer 100 also has an intermediate transfer belt 11 that travels in direction A and is used as an intermediate transfer member. The image forming units 2W, 2Y, 2M, 2C, 2K are placed in a row along the direction A. In the following description, when it is not necessary to identify the image forming units individually, they will be referred to as image forming units 2.

The image forming units 2 form respective developing agent images, more specifically, toner images. The toner images formed by the image forming units 2 are transferred onto the intermediate transfer belt 11.

The image forming units 2 have respective photosensitive drums 3W, 3Y, 3M, 3C, 3K (referred to below as photosensitive drums 3 when it is not necessary to identify them individually), respective charging rollers 4W, 4Y, 4M, 4C, 4K (referred to below as charging rollers 4 when it is not necessary to identify them individually), respective LED heads 5W, 5Y, 5M, 50, 5K (referred to below as LED heads 5 when it is not necessary to identify them individually), respective supply rollers 6W, 6Y, 6M, 6C, 6K (referred to below as supply rollers 6 when it is not necessary to identify them individually), respective developing blades 7W, 7Y, 7M, 7C, 7K (referred to below as developing blades 7 when it is not necessary to identify them individually), respective developing rollers 8W, 8Y, 8M, 8C, 8K (referred to below as developing rollers 8 when it is not necessary to identify them individually), respective cleaning blades 9W, 9Y, 9M, 9C, 9K (referred to below as cleaning blades 9 when it is not necessary to identify them individually), and respective toner cartridges 10W, 10Y, 10M, 10C, 10K (referred to below as toner cartridges 10 when it is not necessary to identify them individually).

The photosensitive drum 3 is a rotatably supported image carrier.

The charging roller 4 is charged to a negative voltage in order to uniformly charge the surface of the photosensitive drum 3 via contact with the charging roller 4.

The LED head 5 emits light in accordance with printing data; areas of the negatively charged photosensitive drum 3 exposed to the light become discharged, forming an electrostatic latent image on the photosensitive drum 3.

The supply roller 6 is disposed in contact with the developing roller 8 and supplies toner as a developing agent to the developing roller 8.

The developing blade 7 regulates the thickness of the toner supplied to the developing roller 8 so that a thin layer of toner is formed on the developing roller 8.

The developing roller 8 develops the electrostatic latent image by making the toner adhere to the image.

The cleaning blade 9 scrapes off and disposes of residual toner on the photosensitive drum 3.

The toner cartridge 10 holds a supply of toner.

Primary transfer rollers 12-1, 12-2, 12-3, 12-4, 12-5 (referred to below as primary transfer rollers 12 when it is not necessary to identify them individually) are disposed as primary transfer members opposite the respective photosensitive drums 3 across the intermediate transfer belt 11. Each primary transfer roller 12 is urged towards the photosensitive drum 3 by a spring (not shown), forming a primary transfer nip between the primary transfer roller 12 and the photosensitive drum 3. In the primary transfer nip, the toner image formed on the photosensitive drum 3 is transferred to the intermediate transfer belt 11 by a primary transfer voltage applied to the primary transfer roller 12.

The positions of the image forming units 2 relative to the intermediate transfer belt 11 can be changed by respective up/down solenoids 13-1, 13-2, 13-3, 13-4, 13-5 (referred to below as up/down solenoids 13 when it is not necessary to identify them individually) that function as displacement units. For example, each image forming unit 2 can be independently switched by the up/down solenoid 13 between a contact position in which the photosensitive drum 3 of the image forming unit 2 makes contact with the intermediate transfer belt 11 and a separated position in which the photosensitive drum 3 of the image forming unit 2 is spaced apart from the intermediate transfer belt 11. To bring the image forming unit 2 into the separated position, the up/down solenoid 13 lifts the image forming unit 2 up to a separated-position retainer (not shown). To bring the image forming unit 2 into the contact position, the up/down solenoid 13 moves the image forming unit 2 down from the retainer until the image forming unit 2 makes contact with the intermediate transfer belt 11.

The intermediate transfer belt 11 is mounted on a driven roller 14, a non-driven roller 15, and a secondary transfer backup roller 16 at a predetermined tension. When the driven roller 14 is rotated by a belt motor 35 (as described later; see FIG. 2), the intermediate transfer belt 11 is driven in the direction of arrow A. The non-driven roller 15 and secondary transfer backup roller 16 are turned by the movement of the intermediate transfer belt 11.

A recording medium such as paper is stored in a recording medium cassette 17. The recording medium in the recording medium cassette 17 is picked up by a hopping roller 18 and delivered to the nip between a registration roller 19 and a pinch roller 20.

A registration sensor 21 detects that the recording medium has reached the nip between the registration roller 19 and the pinch roller 20. The registration roller 19 sends the recording medium to a secondary transfer nip between the secondary transfer backup roller 16 and a secondary transfer roller 22, which functions as a secondary transfer member, in synchronization with the timing of the arrival of the toner image transferred to the intermediate transfer belt 11 at the secondary transfer nip.

The secondary transfer roller 22 is the transfer member that transfers the toner image transferred to the intermediate transfer belt 11 onto the recording medium.

The secondary transfer roller 22 is disposed opposite the secondary transfer backup roller 16 across the intermediate transfer belt 11 and pushes the intermediate transfer belt 11 against the secondary transfer backup roller 16. The secondary transfer roller 22 and intermediate transfer belt 11 make mutual contact to form the secondary transfer nip. In the secondary transfer nip, the toner image on the intermediate transfer belt 11 is transferred to the recording medium by a secondary transfer voltage applied to the secondary transfer roller 22.

After passing between the secondary transfer roller 22 and the secondary transfer backup roller 16, the recording medium is separated from the intermediate transfer belt 11 and transported to a fuser 23. The fuser 23 includes a heat roller 24, a heater 25 for internally heating the heat roller 24, and a pressure roller 26 for applying pressure to the heat roller 24. The fuser 23 heats and melts the toner on the recording medium to fix the toner image onto the recording medium. The recording medium bearing the fixed toner image is guided by a transport guide 27 and discharged into a tray 28 provided at the top of the housing of the printer 100.

Downstream from the secondary transfer nip of the intermediate transfer belt 11, a cleaning blade 29 for removing residual toner from the intermediate transfer belt 11 is disposed opposite a cleaning blade backup roller 30. The cleaning blade 29 is formed from a pliable rubber or plastic material and scrapes residual toner from the intermediate transfer belt 11 into a spent toner tank 31 after the secondary transfer process.

Figure 2:
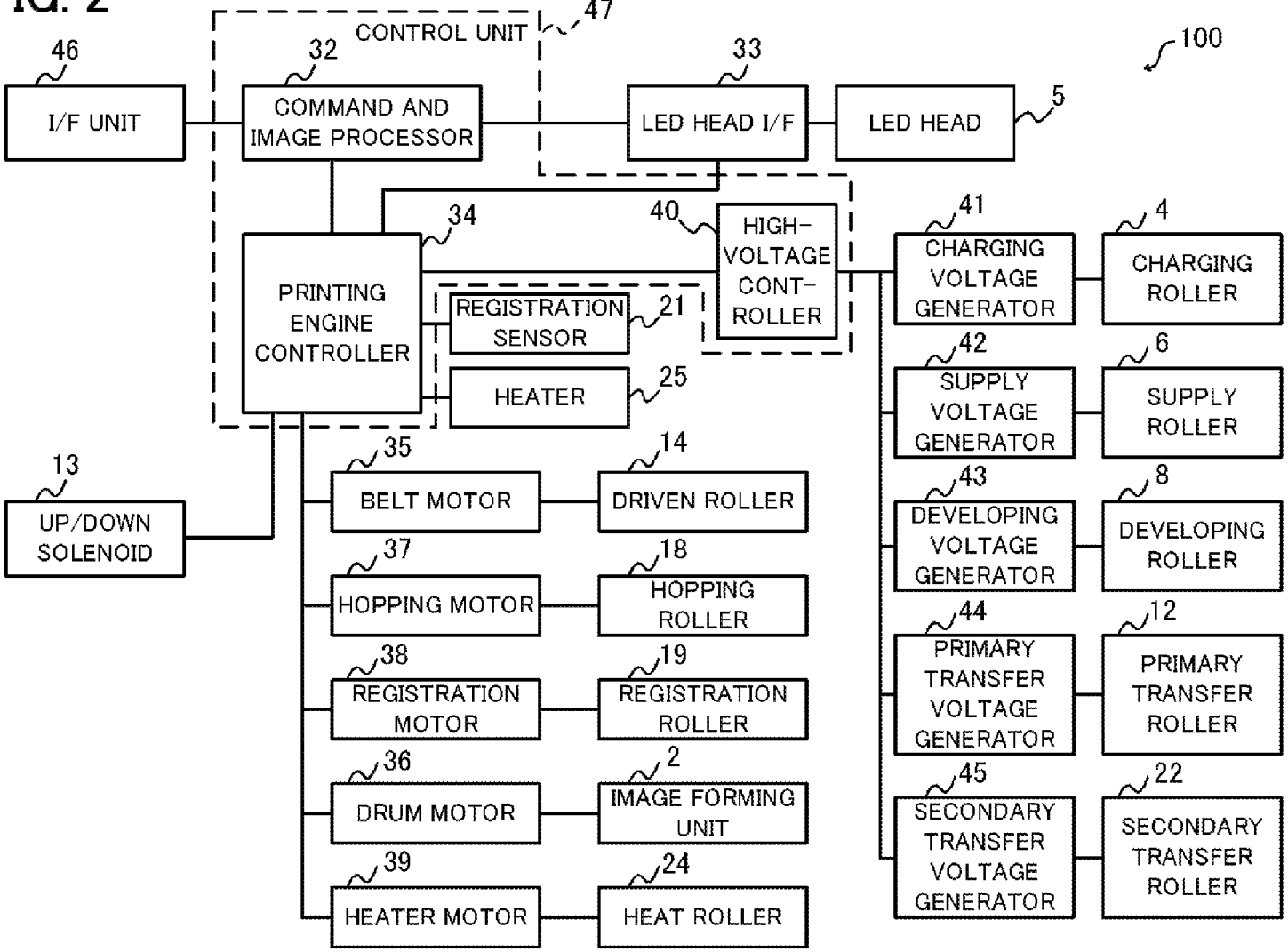
FIG. 2 is a block diagram showing relevant parts of the control system of the printer in the first embodiment.

FIG. 2 is a block diagram showing relevant components of the control system of the printer 100 in the first embodiment.

The general operation of the printer 100 is controlled by a command and image processor 32. For example, the command and image processor 32 processes commands and image data sent from a host device. The printer 100 is connected to a network (not shown) via an interface (I/F) unit 46 and obtains commands and image data from a computer functioning as the host device.

An LED head interface (I/F) 33 sends image data which have been received from the command and image processor 32 and converted to bitmaps to the LED heads 5 for the respective colors.

The printing engine of the printer 100 is controlled by a printing engine controller 34. The printing engine controller 34 controls the driving of the up/down solenoids 13, the belt motor 35, a drum motor 36, a hopping motor 37, a registration motor 38, and a heater motor 39, monitors the registration sensor 21, and controls the heater 25 and a high-voltage controller 40 in accordance with instructions from the command and image processor 32.

The high-voltage controller 40 is responsible for controlling a charging voltage generator 41, a supply voltage generator 42, a developing voltage generator 43, a primary transfer voltage generator 44 used as a primary transfer voltage supply unit, and a secondary transfer voltage generator 45 used as a secondary transfer voltage supply unit in accordance with instructions from the printing engine controller 34.

The command and image processor 32, printing engine controller 34, and high-voltage controller 40 together function as a control unit 47 for controlling the processing performed in the printer 100. For example, the control unit 47 selects one or more of the image forming units 2 to transfer toner images to the intermediate transfer belt 11 according to the colors of the image to be formed on a recording medium. The control unit 47 may be implemented by a CPU executing prescribed programs stored in a storage device (not shown).

The charging voltage generator 41 turns the supply of the charging voltage to the charging rollers 4 on and off responsive to instructions from the high-voltage controller 40.

The supply voltage generator 42 turns the supply of the voltage supplied to the supply rollers 6 on and off responsive to instructions from the high-voltage controller 40.

The developing voltage generator 43 turns the supply of the developing voltage supplied to the developing rollers 8 on and off responsive to instructions from the high-voltage controller 40.

The primary transfer voltage generator 44 turns the supply of the primary transfer voltage supplied to the primary transfer rollers 12 on and off responsive to instructions from the high-voltage controller 40.

The secondary transfer voltage generator 45 turns the supply of the secondary transfer voltage to the secondary transfer roller 22 on and off according to the operating status of the printer 100 responsive to instructions from the high-voltage controller 40. The secondary transfer voltage generator 45 is capable of generating voltages of both positive and negative polarities. For example, the secondary transfer voltage generator 45 varies the secondary transfer voltage supplied to the secondary transfer roller 22 before and/or after the toner image transferred to the intermediate transfer belt 11 is transferred to the recording medium according to the number of image forming units 2 selected to transfer toner images to the intermediate transfer belt 11. When a single image forming unit 2 is selected, the secondary transfer voltage generator 45 supplies a voltage, of the polarity reverse to the normal electrical charge characteristic of the toner to the secondary transfer roller 22. When two or more image forming units 2 are selected, the secondary transfer voltage generator 45 supplies a voltage of the polarity matching the normal electrical charge characteristic of the toner to the secondary transfer roller 22.

The operation of the printer 100 in the first embodiment is described below.

Figure 3:
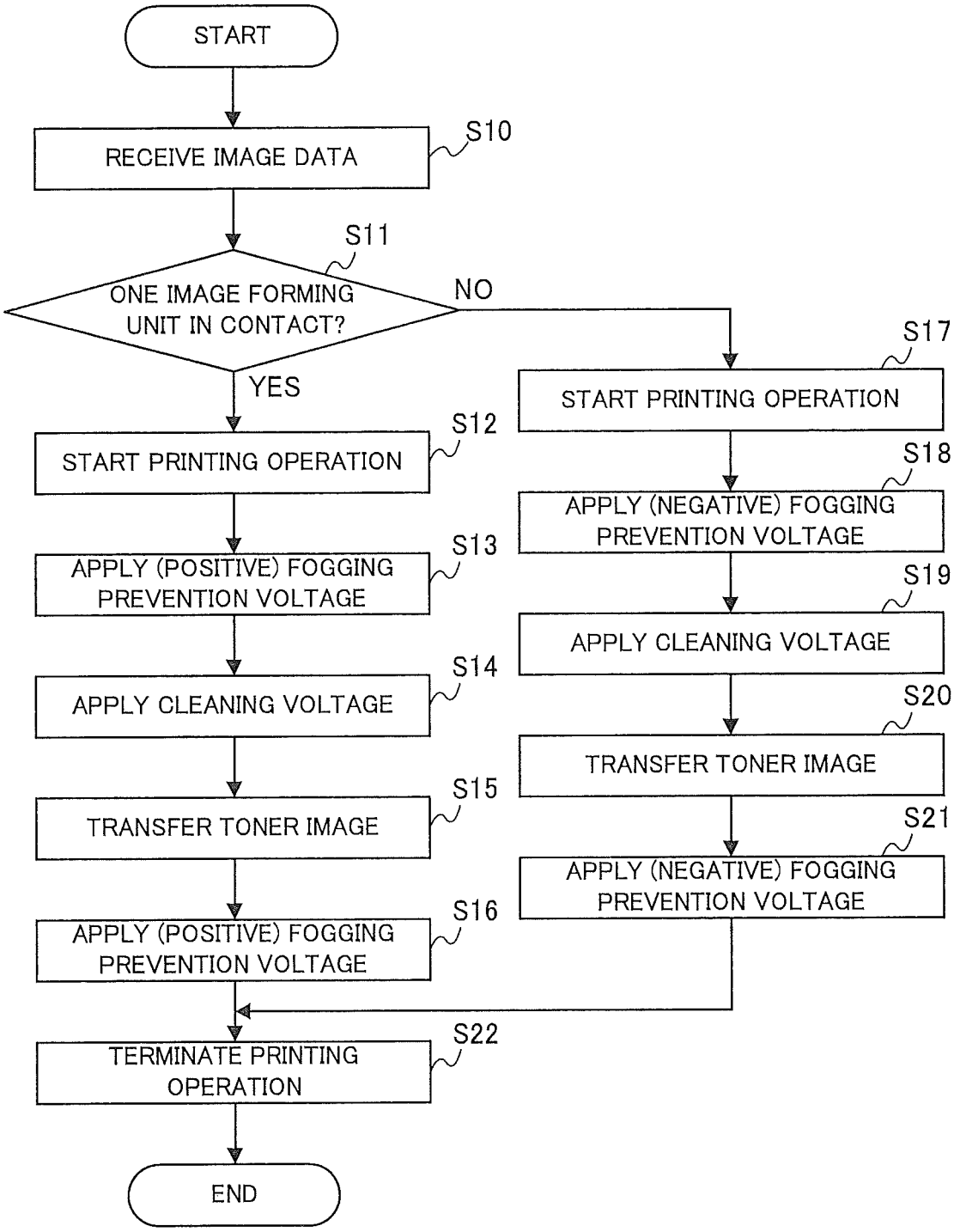
FIG. 3 is a flowchart illustrating the operation of the printer in the first embodiment.

Referring to the flowchart in FIG. 3, when printing data created on the host device are transmitted to the printer 100, the command and image processor 32 receives the printing data via the interface unit 46 (S10). The command and image processor 32 warms up the fuser 23 and converts image data included in the printing data into bitmap data for printing.

From the received printing data, the command and image processor 32 also decides which of the image forming units 2W, 2Y, 2M, 2C, 2K to use for printing (S11).

If the printing data are data for printing in the single color white, the command and image processor 32 decides to use only one image forming unit 2, namely the white image forming unit 2W. When the command and image processor 32 decides to use only one image forming unit 2 (S11: Yes), it proceeds to step S12. In particular, when the command and image processor 32 decides not to use any of the image forming units 2Y, 2M, 2C, 2K disposed downstream of the white image forming unit 2W, it proceeds to step S12. When the command and image processor 32 decides to use more than one image forming unit (S11: No), it proceeds to step S17. In particular, when the command and image processor 32 decides to use any of the other image forming units 2Y, 2M, 2C, 2K as well as the white image forming unit 2W, it proceeds to step S17.

In step S12, the command and image processor 32 controls the heat roller 24 to heat the fuser 23 to a temperature high enough to fix the toner image. When the fuser 23 becomes sufficiently hot, the printing engine controller 34 sets the white image forming unit 2W in the contact position and the other image forming units 2Y, 2M, 2C, 2K in the separated position and starts a printing operation based on the printing bitmap data. In the printing operation, the printing engine controller 34 first controls the belt motor 35 and the white drum motor 36, and actuates the driven roller 14 and the white image forming unit 2W to drive the intermediate transfer belt 11 in the direction of arrow A. Next the printing engine controller 34 controls the high-voltage controller 40 to activate the charging voltage generator 41, supply voltage generator 42, and developing voltage generator 43, which then supply predetermined voltages to the white image forming unit 2W. The printing engine controller 34 also activates the primary transfer voltage generator 44 to supply a predetermined voltage to the white primary transfer roller 12-1.

The toner image forming operation carried out in the image forming units 2 will now be described.

On command from the printing engine controller 34, the high-voltage controller 40 first controls the charging voltage generator 41 to apply a voltage of −1000 V to the charging roller 4. The charging roller 4 charges the surface of the photosensitive drum 3 to −600 V. After the photosensitive drum 3 has been charged, the printing engine controller 34 has the LED head 5 emit light according to the bitmap printing data, reducing the surface charge of the photosensitive drum 3 to −50 V in the areas exposed to the light and forming an electrostatic latent image on the photosensitive drum 3. The rotation of the photosensitive drum 3 carries the electrostatic latent image formed on the photosensitive drum 3 to the point of contact with the developing roller 8. A voltage of −200 V is applied to the developing roller 8 by the developing voltage generator 43 and a voltage of −250 V is applied to the supply roller 6 by the supply voltage generator 42. As a result, toner supplied from the toner cartridge 10 is negatively charged by friction with the charged supply roller 6 and developing roller 8. The negatively charged toner adheres to the developing roller 8 due to the potential difference between the developing roller 8 and the supply roller 6. The toner on the developing roller 8 is smoothed to a uniform thickness by the developing blade 7 to form a toner layer. The toner layer formed on the developing roller 8 is transported to the point of contact with the photosensitive drum 3 by the rotation of the developing roller 8.

Between the developing roller 8 and photosensitive drum 3, an electric field directed from the photosensitive drum 3 toward the developing roller 8 is generated in the areas of the surface of the photosensitive drum 3 that have been exposed to light and discharged to −50 V. The negatively charged toner on the developing roller 8 therefore adheres to the exposed areas, forming a toner image on the surface of the photosensitive drum 3.

As described above, in the first embodiment, toner used as a developing agent is charged to a negative polarity, which is its normal polarity, and adheres to the electrostatic latent image on the photosensitive drum 3 to develop the image. Some toner on the developing roller 8 has not been charged normally and is either insufficiently charged or charged to a positive polarity. In unexposed areas of the surface of the photosensitive drum 3 which have not been discharged and remain at −600 V, an electric field directed from the developing roller 8 toward the photosensitive drum 3 is generated, so the toner on the developing roller 8 that is not normally charged and has a positive polarity adheres to unexposed areas of the surface of the developing roller 8, that is, areas outside the image forming region. Toner that is not charged to the normal polarity and adheres outside the image forming region is called fogging toner.

The toners used as the developing agents are, for example, pigment yellow 185 for yellow (Y), pigment red 122 for magenta (M), pigment blue 15 for cyan (C), and carbon black for black (K). For these colors, the occurrence of toner not charged to the normal polarity is not problematically high. The white (W) toner, however, uses a titanium dioxide pigment. Titanium dioxide inherently resists charging, or even if it becomes charged by friction, the charge can leak away. For these reasons, a large amount of insufficiently charged white toner or white toner charged to a positive polarity instead of the normal negative polarity occurs. Among the toner colors used in the printer 100, the white (W) toner consequently contains the highest proportion of toner charged to a reverse polarity opposite to its normal electrical charge characteristic, or more generally, toner that is not normally charged.

Fogging toner carried by the intermediate transfer belt 11 adheres to and deposits on the secondary transfer roller 22 when no recording medium is passing through the secondary transfer nip. The fogging toner deposited on the secondary transfer roller 22 soils the reverse side of the recording medium in the next printing operation.

Figure 4:
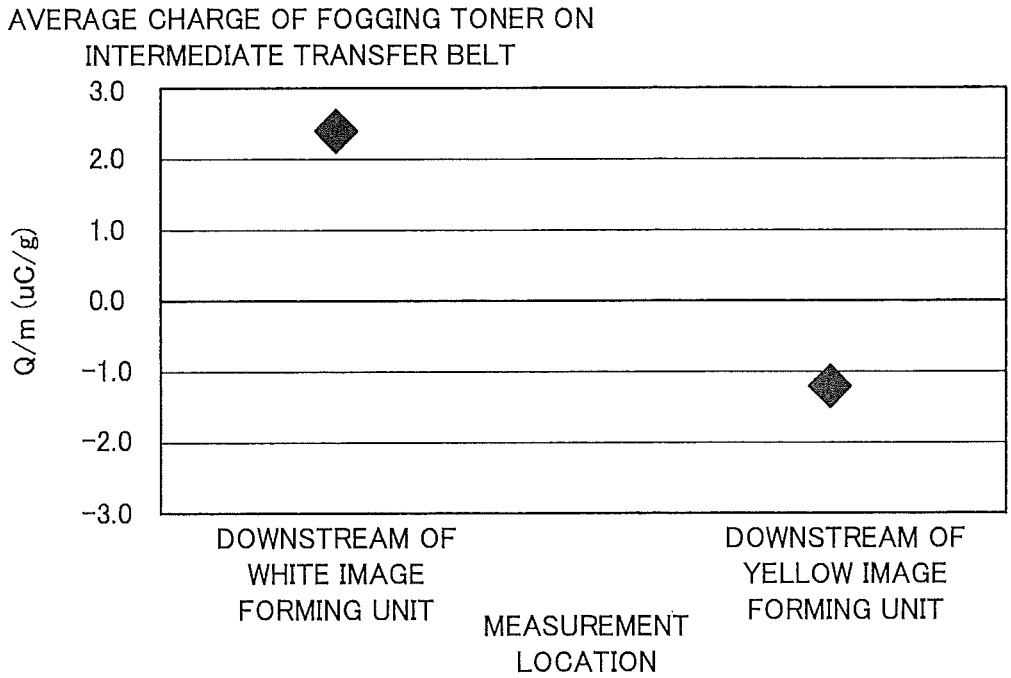
FIG. 4 is a graph schematically showing results of measurements of the average charge of fogging toner on the intermediate transfer belt in the first embodiment.

FIG. 4 schematically shows the results of measurements of the average charge of fogging toner on the intermediate transfer belt 11. In the measurements, a charge measuring device (Model 210HS-3, a compact draw-off charge measurement system available from Trek Inc.) was used to measure the average charges of fogging toner in a printer at points downstream of a white (W) printing unit containing white toner and downstream of a yellow (Y) printing unit containing yellow toner. When single-color printing in white was performed with only one printing unit in the contact position, the fogging toner on the intermediate transfer belt 11 was positively charged as indicated by the average charge measured downstream of the white image forming unit in FIG. 4. When printing was performed with multiple printing units in the contact position, the fogging toner on the intermediate transfer belt 11 was negatively charged as indicated by the average charge measured downstream of the yellow image forming unit in FIG. 4.

Referring again to the flowchart of FIG. 3, after starting the driving of the image forming unit 2 and the supply of voltages thereto, the printing engine controller 34 controls the secondary transfer voltage generator 45 to apply a positive voltage, +1000, V for example, to the secondary transfer roller 22 (S13). When only the white image forming unit 2W is used, the fogging toner on the intermediate transfer belt 11 is positively charged as shown in FIG. 4, so the positive voltage applied to the secondary transfer roller 22 can keep fogging toner from adhering to the secondary transfer roller 22. This voltage is referred to below as a fogging prevention voltage.

When the rotation of photosensitive drum 3W brings the toner image formed on photosensitive drum 3W to the primary transfer nip, a predetermined primary transfer voltage is applied to primary transfer roller 12-1, causing the toner image on photosensitive drum 3W to transfer to the intermediate transfer belt 11 as it passes through the primary transfer nip. Fogging toner on photosensitive drum 3W is also transferred to the intermediate transfer belt 11 because primary transfer roller 12-1 and photosensitive drum 3W are pressed together at a pressure of about nine newtons.

After the primary transfer to the intermediate transfer belt 11, the printing engine controller 34 drives the hopping roller 18 to pick up one sheet of recording media from the recording medium cassette 17 before the toner image transferred to the intermediate transfer belt 11 reaches the secondary transfer nip. The printing engine controller 34 then drives the registration roller 19 to transport the recording medium to the secondary transfer nip in synchronization with the timing of the arrival of the toner image on the intermediate transfer belt 11 at the secondary transfer nip.

At this point, the printing engine controller 34 controls the secondary transfer voltage generator 45 to apply a cleaning voltage to the secondary transfer roller 22 (S14). As the cleaning voltage, the secondary transfer voltage generator 45 alternately applies a positive voltage (e.g., +1500 V) and a negative voltage (e.g., −1500 V), for example. Preferably, the positive and negative cleaning voltages are each applied for a time period representing one revolution of the intermediate transfer belt 11. Any fogging toner remaining on the intermediate transfer belt 11 after the application of the fogging prevention voltage and cleaning voltages is scraped off by the cleaning blade 29 and collected into the spent toner tank 31.

Thus, by applying the fogging prevention voltage to reduce the adherence of toner to the secondary transfer roller 22 as far as possible and applying the cleaning voltage to collect toner still remaining on the secondary transfer roller 22, the printer 100 can avoid degradation of printing quality due to soiling of the reverse side of the recording medium.

Thereafter, in synchronization with the timing of the arrival of the recording medium at the secondary transfer nip, the printing engine controller 34 controls the secondary transfer voltage generator 45 to apply a secondary transfer voltage of +2500 V to the secondary transfer roller 22, causing the toner image on the intermediate transfer belt 11 to be transferred to the recording medium (S15).

After the recording medium passes through the secondary transfer nip, the printing engine controller 34 controls the secondary transfer voltage generator 45 to apply a positive voltage (+1000 V for example) to the secondary transfer roller 22 as a fogging prevention voltage (S16). This reduces adherence of fogging toner to the secondary transfer roller 22 and prevents soiling of the reverse side of the recording medium in the next printing operation.

After passing through the secondary transfer nip, the recording medium is transported to the fuser 23. In the fuser 23, the recording medium is guided between the heat roller 24, which has been brought to a temperature at which fusing can occur, and the pressure roller 26, which applies pressure, thereby fixing the toner image. The recording medium with the fixed toner image is carried through the transport guide 27 and ejected into the tray 28, completing the printing operation (S22).

If the printing data received by the command and image processor 32 are data for printing in full color including white, the command and image processor 32 decides to use multiple image forming units 2W, 2Y, 2M, 2C, 2K for printing (S11: No), and proceeds to step S17.

In step S17, the command and image processor 32 controls the heat roller 24 to heat the fuser 23 to a temperature high enough to fix the toner image. When the fuser 23 becomes sufficiently hot, the printing engine controller 34 brings all of the image forming units 2W, 2Y, 2M, 2C, 2K into contact with the intermediate transfer belt 11 before starting the printing operation according to the bitmap printing data.

As mentioned above, the image forming unit 2W using white (W) toner produces much fogging toner that can adhere to the secondary transfer roller 22 and soil the underside of the recording medium during printing.

When two image forming units 2 are used, the average charge of the fogging toner on the intermediate transfer belt 11 is negative as indicated by the measurements of the average charge of fogging toner on the intermediate transfer belt shown in FIG. 4.

This phenomenon can be explained as follows. Most of the fogging toner transferred from image forming unit 2W to the intermediate transfer belt 11 is negatively charged, but positively charged toner is also present because of the natural distribution of toner charge. When the fogging toner on the intermediate transfer belt 11 passes through the primary transfer nip of the downstream image forming unit 2Y, the positively charged fogging toner on the intermediate transfer belt 11 is transferred to photosensitive drum 3Y by the electric field formed by the positive voltage applied to primary transfer roller 12 (an electric field directed from primary transfer roller 12-2 toward photosensitive drum 3Y). When an image forming unit 2Y located downstream of image forming unit 2W is also used, therefore, the proportion of negatively charged fogging toner increases and the average charge of the toner on the intermediate transfer belt 11 becomes negative. Likewise, when the photosensitive drums 3M, 3C, and 3K located downstream in the direction of travel of the intermediate transfer belt 11 are used, positively charged fogging toner on the intermediate transfer belt 11 shifts to the photosensitive drums 3M, 3C, and 3K, leaving a higher proportion of negatively charged fogging toner on the intermediate transfer belt 11 and making the average charge of the toner on the intermediate transfer belt 11 negative.

Accordingly, when multiple image forming units 2 are used, the printing engine controller 34 controls the secondary transfer voltage generator 45 to apply a negative voltage such as −1000 V to the secondary transfer roller 22 as the fogging prevention voltage (S18), thereby preventing adherence of fogging toner to the secondary transfer roller 22.

The image forming units 2W, 2Y, 2M, 2C, 2K perform toner image formation operations, and the toner images formed by the image forming units 2W, 2Y, 2M, 2C, 2K are sequentially transferred to the intermediate transfer belt 11 in the primary transfer operation described above.

Before the recording medium reaches the secondary transfer nip, the printing engine controller 34 controls the secondary transfer voltage generator 45 to apply a cleaning voltage to the secondary transfer roller 22 (S19). For example, the secondary transfer voltage generator 45 alternately applies a positive voltage (e.g., +1500 V) and a negative voltage (e.g., −1500 V) as the cleaning voltage.

Thus, by applying a fogging prevention voltage to reduce adherence of toner to the secondary transfer roller 22 as far as possible and applying a cleaning voltage to collect toner still remaining on the secondary transfer roller 22, the printer 100 can avoid degradation of printing quality due to soiling of the reverse side of the recording medium.

Thereafter, in synchronization with the timing of the arrival of the recording medium at the secondary transfer nip, the printing engine controller 34 controls the secondary transfer voltage generator 45 to apply a secondary transfer voltage of +2500 V to the secondary transfer roller 22, transferring the toner image on the intermediate transfer belt 11 to the recording medium (S20).

After the recording medium passes through the secondary transfer nip, the printing engine controller 34 controls the secondary transfer voltage generator 45 to apply a negative fogging prevention voltage (−1000 V for example) to the secondary transfer roller 22 (S21), thereby preventing adherence of fogging toner to the secondary transfer roller 22 and soiling of the reverse side of the recording medium in the next printing operation. The flow then proceeds to step S22, where the printing operation ends (S22).

Figure 5:
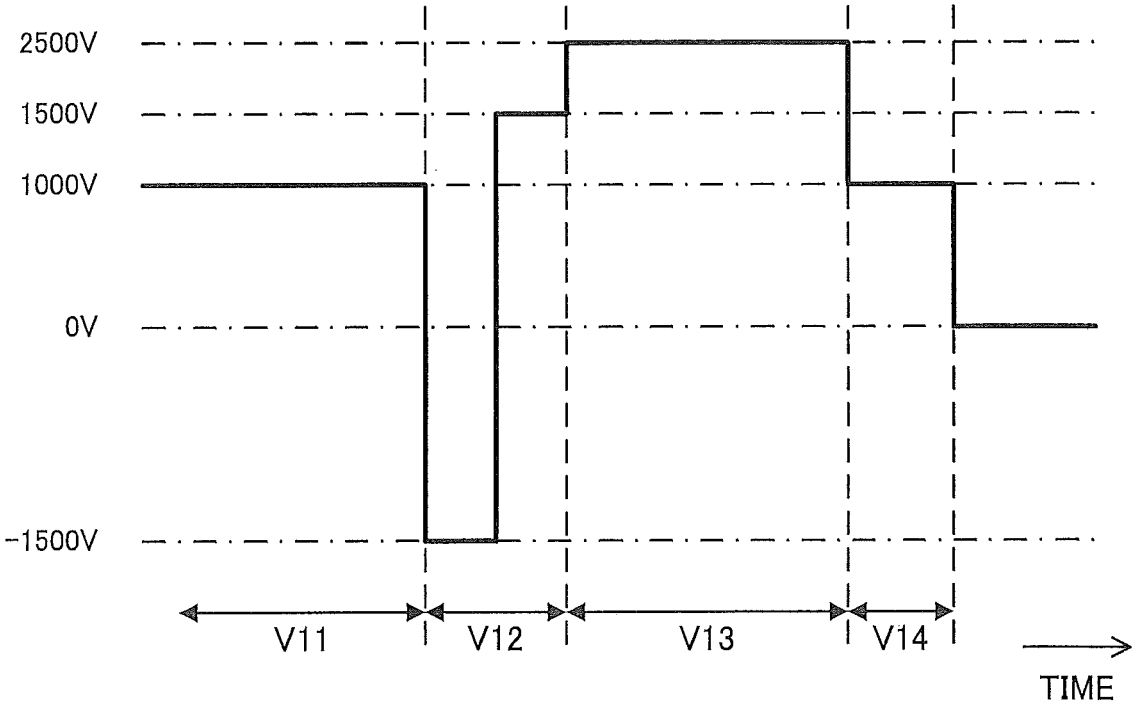
FIG. 5 is a diagram schematically depicting the voltage waveform applied by the secondary transfer voltage generator to the secondary transfer roller in the first embodiment when only the white image forming unit is used.

FIG. 5 is a diagram schematically illustrating the waveform of the voltage applied to the secondary transfer roller 22 by the secondary transfer voltage generator 45 when only the white image forming unit 2W is used.

On command from the printing engine controller 34, the secondary transfer voltage generator 45 first applies a positive fogging prevention voltage V11 before the secondary transfer of the toner image.

Following application of cleaning voltages V12, the secondary transfer voltage generator 45 applies a secondary transfer voltage V13.

After the secondary transfer of the toner image, the secondary transfer voltage generator 45 applies a positive fogging prevention voltage V14 responsive to a command from the printing engine controller 34.

Figure 6:
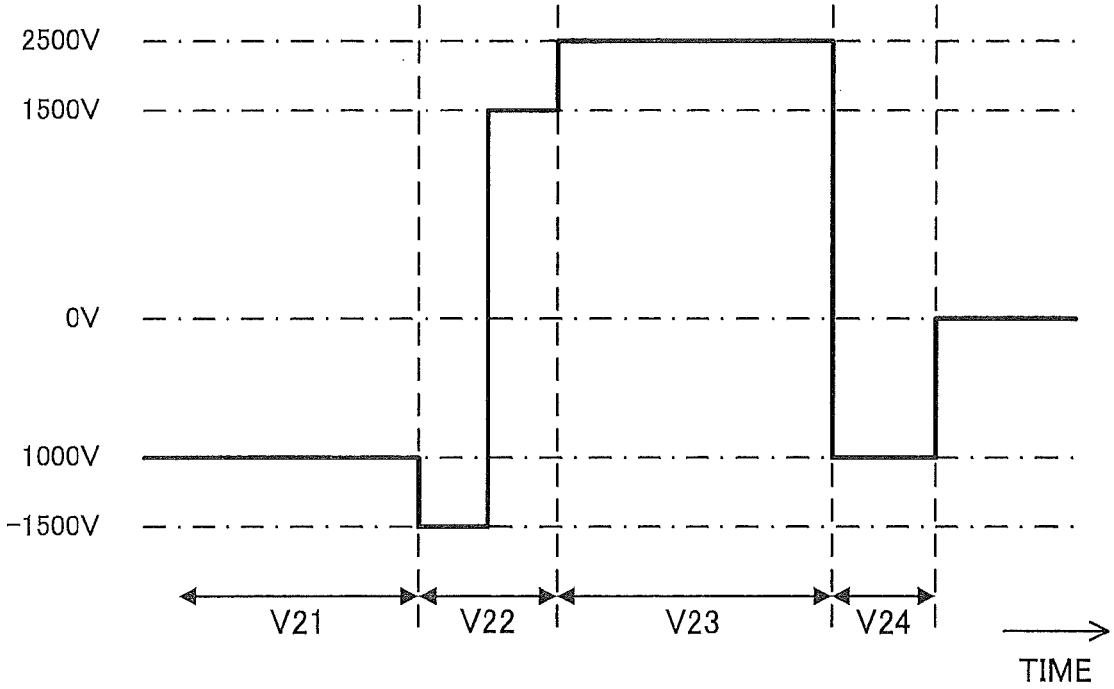
FIG. 6 is a diagram schematically depicting the voltage waveform applied by the secondary transfer voltage generator to the secondary transfer roller in the first embodiment when a plurality of image forming units are used.

FIG. 6 is a diagram schematically illustrating the waveform of the voltage applied to the secondary transfer roller 22 by the secondary transfer voltage generator 45 when a plurality of the image forming units 2W, 2Y, 2M, 2C, 2K are used.

On command from the printing engine controller 34, the secondary transfer voltage generator 45 first applies a negative fogging prevention voltage V21 before the secondary transfer of the toner image.

Following application of cleaning voltages V22, the secondary transfer voltage generator 45 applies a secondary transfer voltage V23.

After the secondary transfer of the toner image, the secondary transfer voltage generator 45 applies a negative fogging prevention voltage V24 responsive to a command from the printing engine controller 34.

Figure 7:
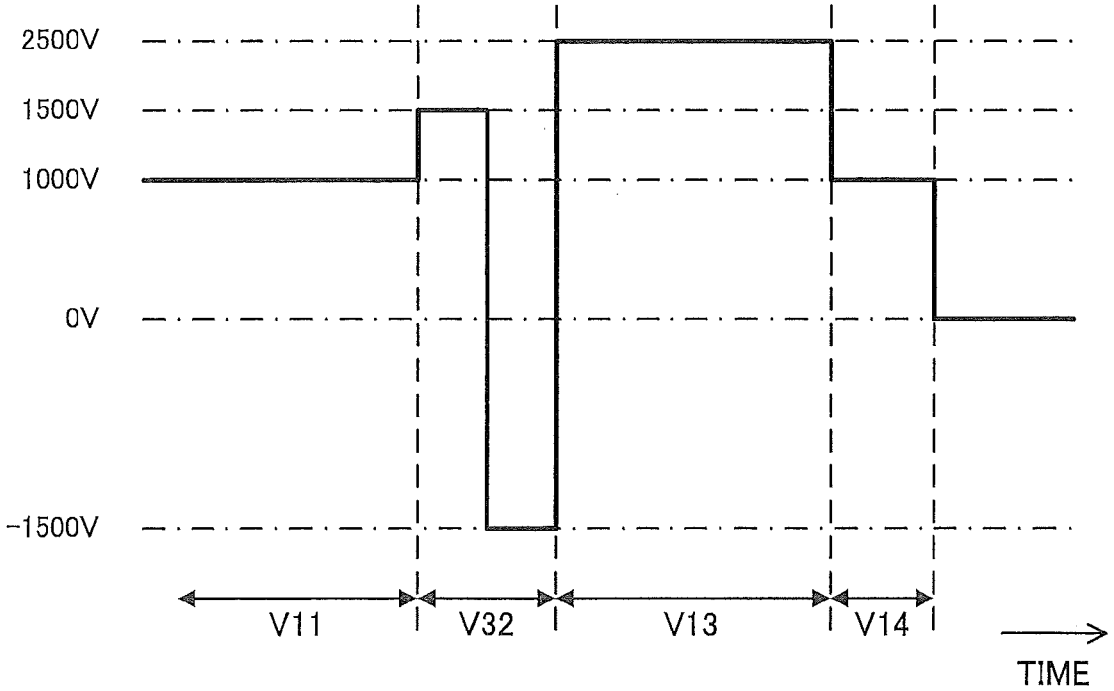
FIG. 7 is a diagram schematically depicting a variation of the voltage waveform applied by the secondary transfer voltage generator to the secondary transfer roller in the first embodiment when only the white image forming unit is used.

FIG. 7 is a diagram schematically illustrating a variation of the voltage waveform applied by the secondary transfer voltage generator 45 to the secondary transfer roller 22 when only the white image forming unit 2W is used.

In the example shown in FIG. 5, first a negative voltage and then a positive voltage are applied as cleaning voltages V12; in the cleaning voltage waveform V32 in FIG. 7, however, a positive voltage is applied first, followed by a negative voltage. This further enhances the effect of preventing adherence of positively charged fogging toner.

As described above, in the first embodiment, by varying the voltages applied before and after the application of the secondary transfer voltage responsive to the number of image forming units 2 that make contact with the intermediate transfer belt 11, fogging toner from image forming unit 2W is kept from adhering to the secondary transfer roller 22 via the intermediate transfer belt 11. This can avoid reduced printing quality due to soiling of the reverse side of the recording medium regardless of whether one or multiple image forming units 2 make contact with the intermediate transfer belt 11.

Second Embodiment

Figure 8:
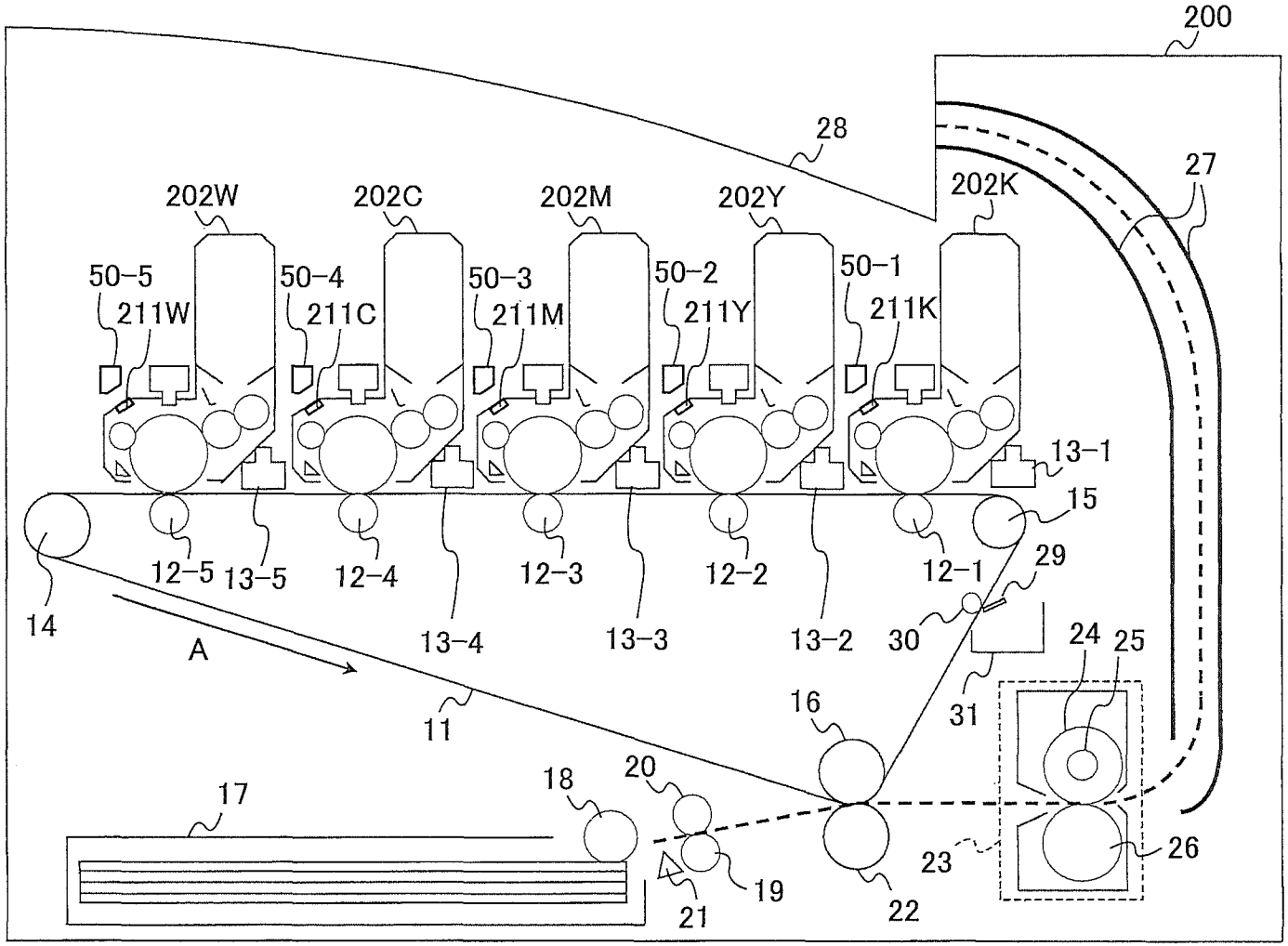
FIG. 8 is a schematic sectional view of the overall structure of a printer in a second embodiment.

Referring to the cross sectional view in FIG. 8, the image forming device in the second embodiment is a printer 200 that differs from the printer 100 in the first embodiment in the structure and disposition of image forming units 202K, 202Y, 202M, 202C, 202W (referred to below as image forming units 202 when it is not necessary to identify them individually) and the addition of transmitting and receiving (Tx/Rx) antennas 50-1, 50-2, 50-3, 50-4, 50-5 (referred to below as transmitting and receiving antennas 50 when it is not necessary to identify them individually) functioning as transceiver units.

The printer 200 in the second embodiment permits rearrangement of the order of the five image forming units 202. As an example, the five image forming units 202 in FIG. 8 are shown as being arranged in the order of black (K), yellow (Y), magenta (M), cyan (C), white (W) from upstream to downstream in the direction of travel of the intermediate transfer belt 11.

The image forming units 202 in the second embodiment are similar in structure to the image forming units 2 of the first embodiment except that they include respective memory tags 211K, 211Y, 211M, 211C, 211W (referred to below as memory tags 211 when it is not necessary to identify them individually) used as data storage units. Each memory tag 211 stores information indicating the color of the toner in the image forming unit 202 to which the memory tag 211 is attached.

The printing engine controller 234 (see FIG. 9) can determine the order in which the image forming units 202 are arranged by retrieving the toner color information stored in the memory tags 211 through the transmitting and receiving antennas 50.

Figure 9:
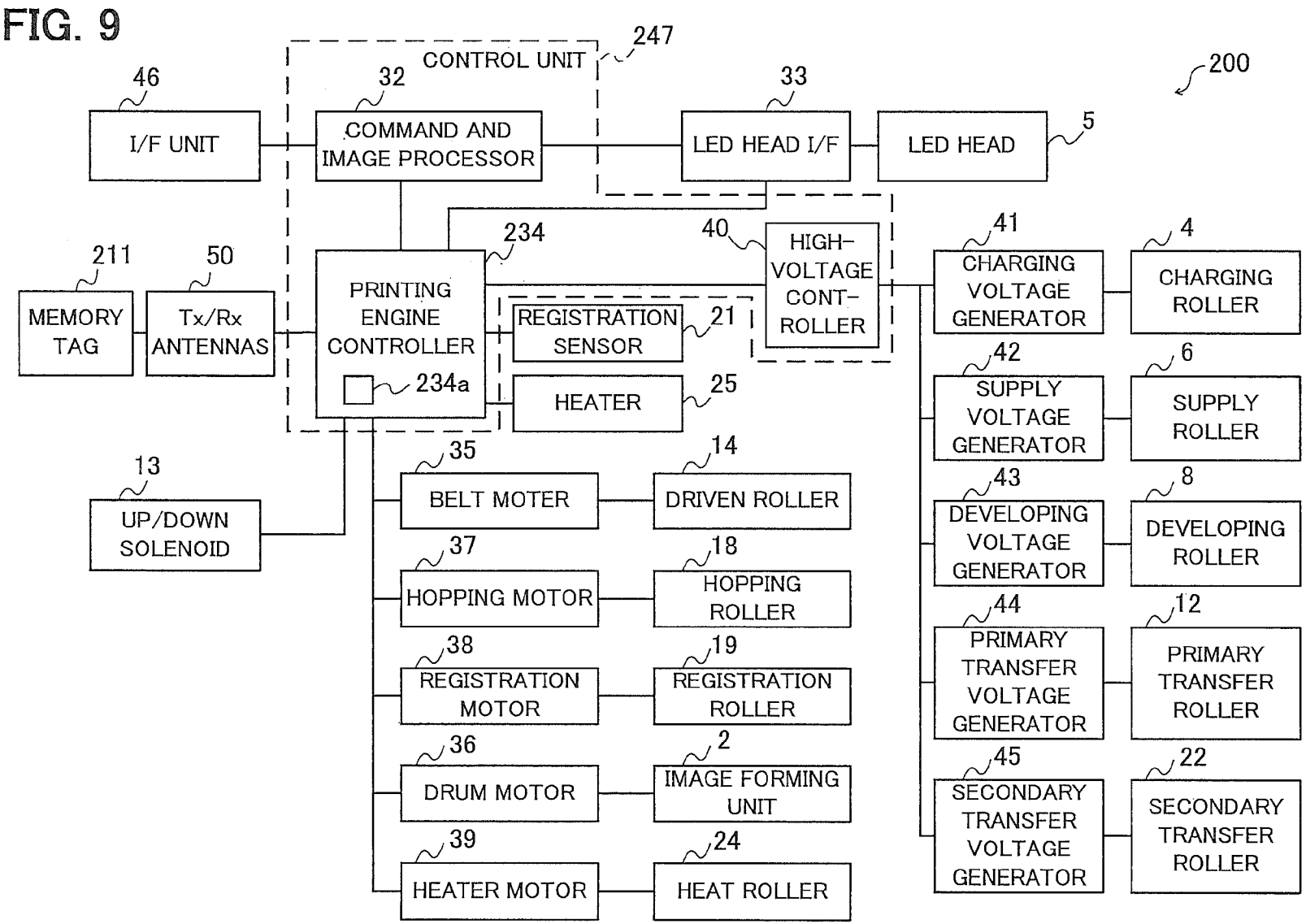
FIG. 9 is a block diagram showing relevant parts of the control system of the printer in the second embodiment.

FIG. 9 is a block diagram showing relevant components of the control system of the printer 200 in the second embodiment.

Except for the processing performed by the printing engine controller 234 in the control unit 247, the control system in the second embodiment is configured in the same way as in the first embodiment.

The printing engine controller 234 in the second embodiment carries out the same control as the printing engine controller 34 in the first embodiment except that it determines the order in which the image forming units 202 are arranged from toner color information received from the memory tags 211 through the transmitting and receiving antennas 50 and varies the fogging prevention voltages responsive to the order of arrangement.

In the second embodiment, the printing engine controller 234 controls the secondary transfer voltage generator 45 via the high-voltage controller 40 to vary the secondary transfer voltage supplied to the secondary transfer roller 22 responsive to the operating status of the printer 200.

For example, the secondary transfer voltage generator 45 varies the secondary transfer voltage supplied to the secondary transfer roller 22 in accordance with the number or disposition of the image forming units 202 selected to transfer toner images to the intermediate transfer belt 11 either before or after or both before and after the toner image transferred to the intermediate transfer belt 11 is transferred to the recording medium.

More specifically, when only one image forming unit 202 is selected, the secondary transfer voltage generator 45 supplies a voltage of reverse polarity, opposite to the normal electrical charging characteristic of the toner to the secondary transfer roller 22. When multiple image forming units 202 are selected, the secondary transfer voltage generator 45 supplies a voltage of a polarity matching the normal electrical charging characteristic of the toner to the secondary transfer roller 22.

When the selected image forming units 202 are disposed such that the white image forming unit 202W transfers the toner image to the intermediate transfer belt 11 last, the secondary transfer voltage generator 45 supplies a voltage of a polarity reverse to the normal electrical charging characteristic of the toner to the secondary transfer roller 22. When the selected image forming units 202 are arranged such that one of the other image forming units 202K, 202Y, 202M, 202C transfers a toner image to the intermediate transfer belt 11 after the white image forming unit 202W, the secondary transfer voltage generator 45 supplies a voltage of a polarity matching the normal electrical charging characteristic of the toner to the secondary transfer roller 22.

When the five image forming units 202 are arranged in the order of black (K), yellow (Y), magenta (M), cyan (C), white (W) as shown in the second embodiment, there only need be at least two image forming units 202 that can be independently switched between a contact position in which the image forming unit 202 is in contact with the intermediate transfer belt 11 and a separated position in which the image forming-unit 202 is spaced apart from the intermediate transfer belt 11. The order of arrangement and number of image forming units 202, as well as the colors and materials of the toners used as developing agents, are merely illustrative and not limiting.

The operation of the printer 200 in the second embodiment will now be described with reference to the flowchart in FIG. 10. A description of the basic printing operation will be omitted as it is the same as in the first embodiment.

Figure 10:
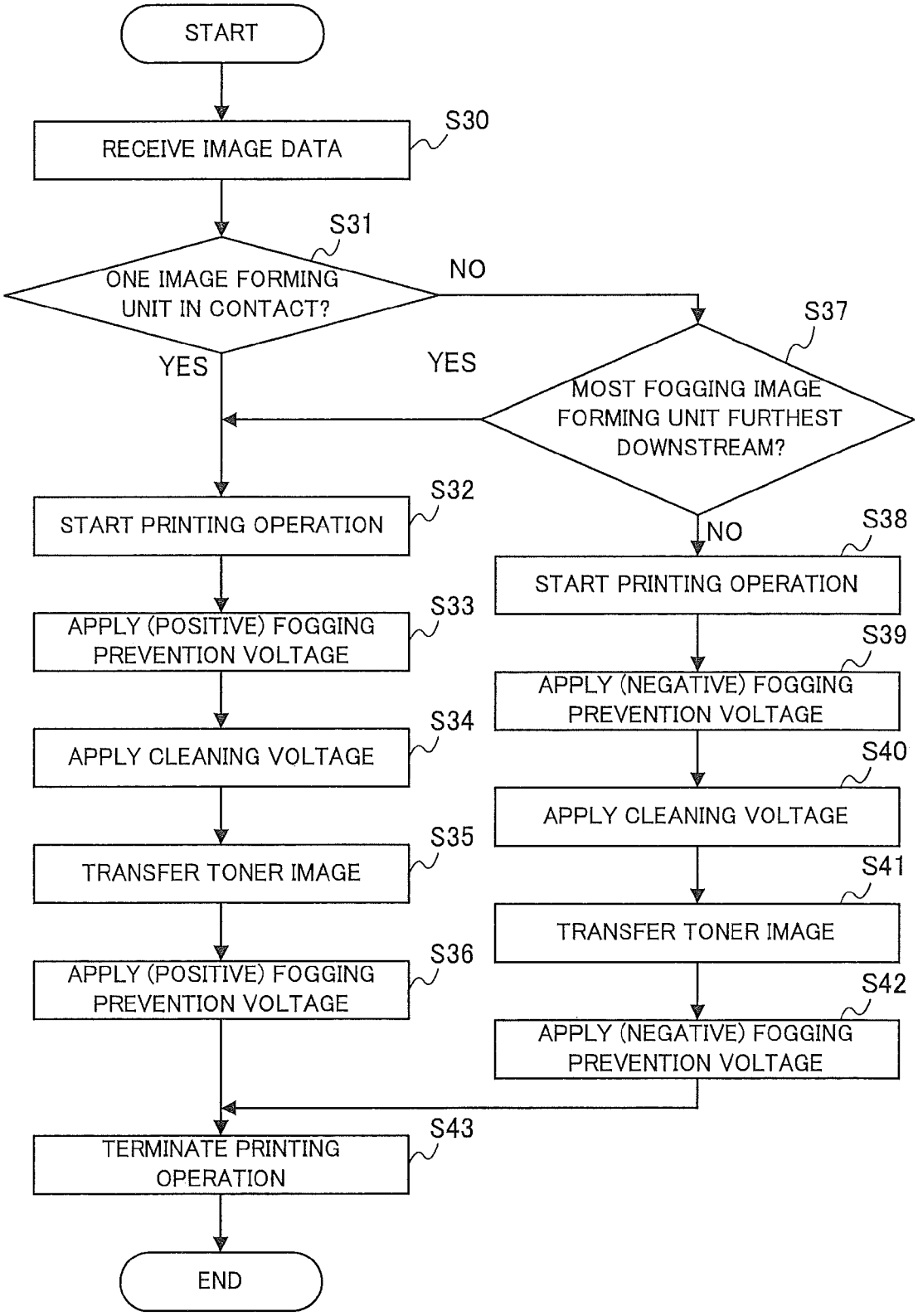
FIG. 10 is a flowchart illustrating the operation of the printer in the first embodiment.

The flowchart in FIG. 10 is entered when the printing engine controller 234 detects that the printer 200 has been switched on or when a sensor or the like (not shown) detects that the top cover (not shown) of the printer 200 has been opened or closed. In either case, since the image forming units 202 may have been rearranged, the printing engine controller 234 interrogates the memory tags 211 through the transmitting and receiving antennas 50 and identifies the current order of arrangement of the image forming units 202 from the color information retrieved from the memory tags 211. The description that follows continues to assume that the image forming units 202 are arranged in the order of black (K), yellow (Y), magenta (M), cyan (C), white (W) in the direction of travel of the intermediate transfer belt 11 as depicted in FIG. 8.

When printing data created on the host device are transmitted to the printer 200, the command and image processor 32 receives the printing data via the interface unit 46 (S30). The command and image processor 32 warms up the fuser 23 and converts image data included in the printing data into bitmap data for printing.

From the received printing data the command and image processor 32 also decides which of the image forming units 202K, 202Y, 202M, 202C, 202W to use for printing (S31).

If the printing data are data for printing in the single color white, the command and image processor 32 uses only the white image forming unit 202W for printing. The command and image processor 32 accordingly decides to use only one image forming unit 202 (S31: Yes), and proceeds to step S32. If the command and image processor 32 decides to use more than one image forming unit (S31: No), it proceeds to step S37.

In step S32, the printing engine controller 234 sets the image forming unit 202W in the contact position and the other image forming units 202Y, 202M, 202C, 202K in the separated position and starts a printing operation based on the printing bitmap data (S32). The processes carried out in the following steps S33 to S36 and S43 are similar to the processes in steps S13 to S16 and S22 shown in FIG. 3.

If the printing data received by the command and image processor 32 are data for printing in full color, including white, the command and image processor 32 decides to use multiple image forming units 202W, 202Y, 202M, 202C, 202K for printing (S31: No), and proceeds to step S37.

In step S37, the printing engine controller 234 determines, from the order of the image forming units 202 identified from color information stored in the memory tags 211, whether the furthest downstream image forming unit 202 contains toner of the color that produces the greatest amount of fogging (S37). The order of arrangement assumed in the description of the second embodiment is black (K), yellow (Y), magenta (M), cyan (C), white (W), and since white toner causes more fogging than the other toner colors, the printing engine controller 234 decides that the furthest downstream image forming unit 202 contains toner of the color producing the greatest amount of fogging (S37: Yes) and proceeds to step S32. The printing engine controller 234 may have a memory 234*a* used as a most fogging color memory for storing specific color information indicating the toner color that generates the greatest amount of fogging, for example. If the color indicated by the color information from the image forming unit disposed furthest downstream matches the color indicated by the specific color information stored in the memory 234*a*, the printing engine controller 234 decides that the furthest downstream image forming unit 202 contains toner of the color producing the greatest amount of fogging.

In step S32, the printing engine controller 234 places all of the image forming units 202Y, 202M, 202C, 202K, 202W in the contact position, starts a printing operation based on the printing bitmap data, and then proceeds to step S33.

If the finding in step S37 is the furthest downstream image forming unit 202 does not contain toner of the color producing the greatest amount of fogging (S37: No), in other words, when the furthest downstream image forming unit 202 contains toner of a color other than the color that produces the greatest amount of fogging (white), namely black, yellow, magenta, or cyan, the printing engine controller 234 proceeds to step S38.

The processing in the following steps S38 to S43 is the same as the processing in steps S17 to S22 in FIG. 3, described above.

In the second embodiment, when an image forming unit 202 that produces much fogging toner, e.g., white (W) fogging toner, is not used but multiple image forming units 202 that produce mutually similar amounts of fogging toner are used, fogging prevention voltages are applied as described below.

Figure 11:
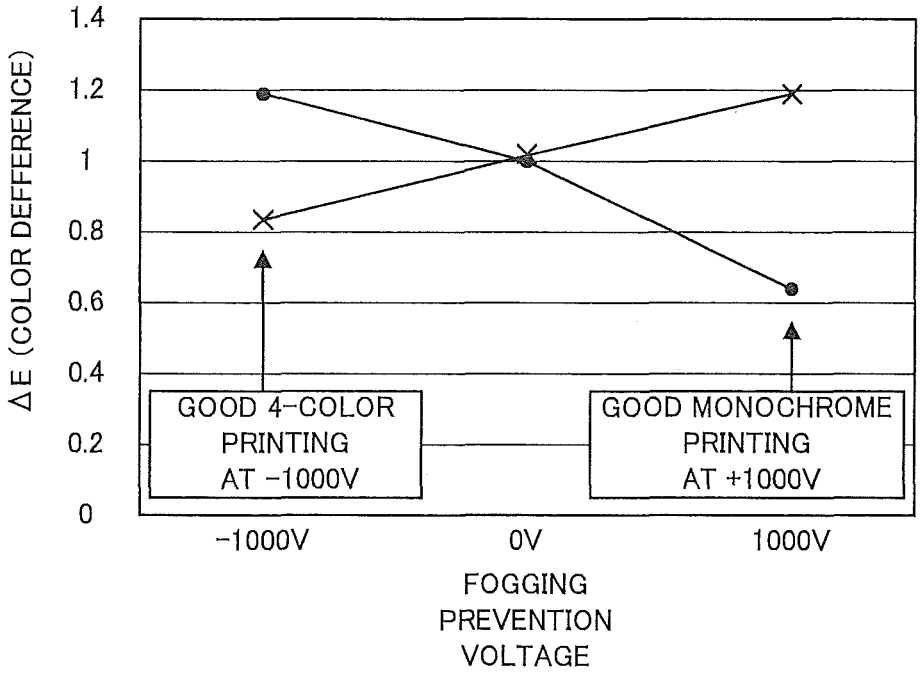
FIG. 11 is a graph schematically showing results of measurements of discoloration as a function of fogging prevention voltage in the second embodiment.

FIG. 11 is a table showing the results of measurements of discoloration (color difference ΔE) as a function of fogging prevention voltage, where color difference ΔE represents soiling on the underside of the recording medium. The measurements were carried out with a spectrophotometer (CM-2600d available from Konica Minolta). The color difference ΔE was calculated by comparing a Lab value measured on the reverse side of unprinted recording media and a Lab value measured on the reverse side of printed recording media. A smaller ΔE value in FIG. 11 indicates less discoloration.

As can be seen from FIG. 11, in monochrome printing using only black (K), discoloration was low when a voltage of +1000 V was applied as a fogging prevention voltage. In full color printing using black (K), yellow (Y), magenta (M), and cyan (C), discoloration was low when a voltage of −1000 V was applied as a fogging prevention voltage.

The results of FIG. 11 are assumed to arise from the following circumstances as described in the first embodiment:

(a) The average charge of black (K) fogging toner transferred from the image forming unit 202 to the intermediate transfer belt 11 is positive; and (b) The total sum of the charges of black (K), yellow (Y), and magenta (M) fogging toners, which have negative average charges due to passing through downstream image forming units 202, and the charge of cyan (C) fogging toner, having a positive average charge, is negative.

On the basis of the results of measurements, the printer 200 in the second embodiment operates as follows.

If the printing data received by the command and image processor 32 are data for monochrome printing, the toner image is formed by image forming unit 202K alone. The command and image processor 32 accordingly decides to use only one image forming unit 202 in step S31 of FIG. 10 (S31: Yes). In step S32, the printing engine controller 34 places the image forming unit 202K in the contact position and the image forming units 202W, 202Y, 202M, 202C in the separated position, and starts a printing operation based on the printing bitmap data. In steps S33 and S36, the secondary transfer voltage generator 45 applies a positive voltage to the secondary transfer roller 22 as a fogging prevention voltage.

When the printing data received by the command and image processor 32 are data for full color printing in four colors not including white, multiple image forming units 202K, 202Y, 202M, 202C are used for printing. The command and image processor 32 accordingly decides to use multiple image forming units 202 in step S31 of FIG. 10 (S31: No), and proceeds to step S37. In step S37, the printing engine controller 234 decides whether the furthest downstream image forming unit 202 contains toner of the color that produces the greatest amount of fogging. Since the image forming units are disposed in the order of black (K), yellow (Y), magenta (M), cyan (C), white (W) and the white image forming unit 202W is in the separated position, the printing engine controller 234 decides that the furthest downstream image forming unit 202 does not produce the greatest amount of fogging (S37: No). Next the printing engine controller 234 sets the image forming units 202Y, 202M, 202C, 202K in the contact position and the image forming unit 202W in the separated position, and starts a printing operation based on the printing bitmap data (S38). In steps S39 and S42, the secondary transfer voltage generator 45 applies a negative voltage to the secondary transfer roller 22 as a fogging prevention voltage.

As described above, in addition to the effects provided by the first embodiment, the second embodiment can keep fogging toner from adhering to the secondary transfer roller 22 via the intermediate transfer belt 11 by varying the voltages applied before and after the application of the secondary transfer voltage responsive to the disposition of image forming units 202 that make contact with the intermediate transfer belt 11. It is therefore possible to achieve the effect of averting reduced printing quality due to soiling of the reverse side of recording media regardless of the number of image forming units 202 and their order of arrangement, even if they are rearranged.

In the first and second embodiments described above, a positive voltage is used as a fogging prevention voltage when the image forming unit 2W or 202W containing white (W) toner is used singly or used at the furthest downstream location. This is not a limitation, however; a positive fogging prevention voltage may also be used when any image forming unit 2 or 202 having a toner color that produces more fogging toner than the other toner colors used is used singly or used at the furthest downstream location.

In such an implementation of the second embodiment, specific color information indicating the toner color that produces the most fogging toner may be stored in the memory 234*a*, for example, and the command and image processor 32 or printing engine controller 234 may proceed to step S32 in FIG. 10 when the image forming unit 202 that uses the toner color indicated by the specific color information is used singly or used at the furthest downstream location.

For instance, the carbon black used as a black (K) toner may also produce much toner that is charged to a positive polarity, as indicated by FIG. 11. Thus, when the image forming unit 202 containing black (K) toner is used singly or used at the furthest downstream location, a positive voltage may be applied as a fogging prevention voltage.

The color indicated by the specific color information in such an implementation is preferably a toner color that produces fogging toner whose average charge on the intermediate transfer belt 11 becomes positive when the toner color is used singly.

Although fogging prevention voltages are applied both before and after the toner image transfer to the recording medium in the first and second embodiments described above, these voltages may be applied only before or only after the toner image transfer.

Although +1000 V and −1000 V are applied as the fogging prevention voltages in the descriptions of the embodiments above, the fogging prevention voltages are not limited to these values. For example, the absolute value of the fogging prevention voltage may increase as the number of image forming units used increases.

The first and second embodiments were described by taking printers 100 and 200 as examples of image forming devices. The image forming devices are not limited to printers however; they may be facsimile machines or multi-function devices instead.

Those skilled in the art will recognize that further variations are possible within the scope of the invention, which is defined in the appended claims.

What is claimed is:

1. An image forming device comprising:

a plurality of image forming units for forming developing agent images;

an intermediate transfer member to which the developing agent images are transferred from selected ones of the image forming units;

a transfer member for transferring the developing agent images from the intermediate transfer member to a recording medium to form an image on the recording medium; and a voltage supply unit for supplying a voltage to the transfer member, wherein the voltage supply unit varies the voltage supplied to the transfer member, either before or after the developing agent images are transferred from the intermediate transfer member to the recording medium or both before and after the developing agent images are transferred from the intermediate transfer member to the recording medium, responsive to the number or disposition of the selected image forming units, and wherein the voltage supply unit supplies the transfer member with a voltage of a normal polarity when more than one of the image forming units are selected, and supplies the transfer member with a voltage of a reverse polarity, opposite to the normal polarity, when only one of the image forming units is selected.

2. The image forming device of claim 1, wherein:

the image forming units use respective developing agents with respective normal electrical charge characteristics, a proportion of developing agent charged to a reverse polarity reverse to the normal charge characteristic also being present in each of the image forming units;

the plurality of image forming units include a first image forming unit that forms a developing agent image of a first color and at least one second image forming unit that forms a developing agent image of a second color different from the first color, the first image forming unit having a highest proportion of developing agent charged to the reverse polarity; and the plurality of image forming units are disposed in such a way that the developing agent image formed by at least one second image forming unit is transferred to the intermediate transfer member after the developing agent image formed by the first image forming unit is transferred to the intermediate transfer member.

3. The image forming device of claim 2, wherein the first color is white.

4. The image forming device of claim 1, wherein:

the image forming units use respective developing agents with a normal electrical charge characteristic, a proportion of developing agent charged to a reverse polarity reverse to the normal electrical charge characteristic also being present in each of the image forming units;

the plurality of image forming units include a first image forming unit that forms a developing agent image of a first color and at least one second image forming unit that forms a developing agent image of a second color different from the first color, the first image forming unit having a highest proportion of developing agent charged to the reverse polarity;

when the selected image forming units are disposed in such a way that the developing agent image formed by the first image forming unit is transferred last to the intermediate transfer member, the voltage supply unit supplies the transfer member with a voltage having a polarity reverse to the normal electrical charge characteristic of the developing agents; and when the selected image forming units are disposed in such a way that the developing agent image formed by at least one second image forming unit is transferred to the intermediate transfer member after the developing agent image formed by the first image forming unit is transferred to the intermediate transfer member, the voltage supply unit supplies the transfer member with a voltage having a polarity matching the normal electrical charge characteristic of the developing agents.

5. The image forming device of claim 4, wherein the disposition of the plurality of image forming units can be changed.

6. The image forming device of claim 4, wherein the first color is white.

7. The image forming device of claim 1, further comprising a control unit for selecting the image forming units that transfer developing agent images to the intermediate transfer body from among the plurality of image forming units, responsive to colors of the image formed on the recording medium.

8. The image forming device of claim 7, the plurality of image forming units including respective image carriers on which the developing agent images are formed, the image forming device further comprising:

a displacement unit for changing the position of each of the image carriers between a first position at which image transfer to the intermediate transfer member is carried out and a second position at which image transfer to the intermediate transfer member is not carried out, wherein the displacement unit places the image carriers in the selected image forming units in the first position, and places the image carriers in image forming units other than the selected image forming units in the second position.

9. The image forming device of claim 8, wherein the image carriers make contact with the intermediate transfer member in the first position and do not make contact with the intermediate transfer member in the second position.

10. An image forming device comprising:

a plurality of image forming units for forming developing agent images;

an intermediate transfer member to which the developing agent images are transferred from selected ones of the image forming units;

a transfer member for transferring the developing agent images from the intermediate transfer member to a recording medium to form an image on the recording medium; and a voltage supply unit for supplying a voltage to the transfer member, wherein the voltage supply unit varies the voltage supplied to the transfer member, either before or after the developing agent images are transferred from the intermediate transfer member to the recording medium or both before and after the developing agent images are transferred from the intermediate transfer member to the recording medium, responsive to the number or disposition of the selected image forming units, and wherein the voltage supply unit increases an absolute value of the voltage supplied to the transfer member as the number of selected image forming units increases.

11. The image forming device of claim 10, wherein the voltage supply unit supplies the transfer member with a voltage of a normal polarity when more than one of the image forming units are selected, and supplies the transfer member with a voltage of a reverse polarity, opposite to the normal polarity, when only one of the image forming units is selected.

12. The image forming device of claim 10, wherein the disposition of the plurality of image forming units can be changed.

13. The image forming device of claim 10, further comprising a control unit for selecting the image forming units that transfer developing agent images to the intermediate transfer body from among the plurality of image forming units, responsive to colors of the image formed on the recording medium.

14. The image forming device of claim 10, the plurality of image forming units including respective image carriers on which the developing agent images are formed, the image forming device further comprising:

a displacement unit for changing the position of each of the image carriers between a first position at which image transfer to the intermediate transfer member is carried out and a second position at which image transfer to the intermediate transfer member is not carried out, wherein the displacement unit places the image carriers in the selected image forming units in the first position, and places the image carriers in image forming units other than the selected image forming units in the second position.

15. An image forming device comprising:

a plurality of image forming units for forming developing agent images;

an intermediate transfer member to which the developing agent images are transferred from selected ones of the image forming units;

a transfer member for transferring the developing agent images from the intermediate transfer member to a recording medium to form an image on the recording medium; and a voltage supply unit for supplying a voltage to the transfer member, wherein the voltage supply unit varies the voltage supplied to the transfer member, either before or after the developing agent images are transferred from the intermediate transfer member to the recording medium or both before and after the developing agent images are transferred from the intermediate transfer member to the recording medium, responsive to the number or disposition of the selected image forming units, and wherein the voltage supply unit supplies the transfer member with a voltage of a reverse polarity, opposite to the normal polarity of developing agent of white, when only one of the image forming units is selected and the selected image forming unit forms a developing agent image of white.

16. The image forming device of claim 15, wherein the disposition of the plurality of image forming units can be changed.

17. The image forming device of claim 15, further comprising a control unit for selecting the image forming units that transfer developing agent images to the intermediate transfer body from among the plurality of image forming units, responsive to colors of the image formed on the recording medium.

18. The image forming device of claim 15, the plurality of image forming units including respective image carriers on which the developing agent images are formed, the image forming device further comprising:

a displacement unit for changing the position of each of the image carriers between a first position at which image transfer to the intermediate transfer member is carried out and a second position at which image transfer to the intermediate transfer member is not carried out, wherein the displacement unit places the image carriers in the selected image forming units in the first position, and places the image carriers in image forming units other than the selected image forming units in the second position.

19. The image forming device of claim 15, wherein the voltage supply unit increases an absolute value of the voltage supplied to the transfer member as the number of selected image forming units increases.

20. An image forming device comprising:

a plurality of image forming units for forming developing agent images;

an intermediate transfer member to which the developing agent images are transferred from selected ones of the image forming units;

a transfer member for transferring the developing agent images from the intermediate transfer member to a recording medium to form an image on the recording medium; and a voltage supply unit for supplying a voltage to the transfer member, wherein when only one of the image forming units is selected, the voltage supply unit supplies a voltage different from a voltage supplied when more than one of the image forming units are selected, either before or after the developing agent images are transferred from the intermediate transfer member to the recording medium or both before and after the developing agent images are transferred from the intermediate transfer member to the recording medium.

21. The image forming device of claim 20, wherein, when only one of the image forming units is selected and the selected image forming unit forms a developing agent image of white, the voltage supply unit supplies a voltage different from a voltage which is supplied when more than one of the image forming units are selected.

* * * * *